US011724907B2

(12) United States Patent
Pusala et al.

(10) Patent No.: US 11,724,907 B2
(45) Date of Patent: Aug. 15, 2023

(54) ELEVATOR FLOOR BYPASS

(71) Applicant: OTIS ELEVATOR COMPANY, Farmington, CT (US)

(72) Inventors: Rajinikanth Pusala, Telangana (IN); Pradeep Miriyala, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1105 days.

(21) Appl. No.: 16/433,113

(22) Filed: Jun. 6, 2019

(65) Prior Publication Data

US 2019/0382233 A1 Dec. 19, 2019

(30) Foreign Application Priority Data

Jun. 14, 2018 (IN) ..... 201811022368

(51) Int. Cl.
*B66B 1/34* (2006.01)
*B66B 1/24* (2006.01)
*B66B 1/20* (2006.01)

(52) U.S. Cl.
CPC ..... *B66B 1/2458* (2013.01); *B66B 1/20* (2013.01); *B66B 1/3461* (2013.01); *B66B 1/3492* (2013.01); *B66B 1/3476* (2013.01)

(58) Field of Classification Search
CPC ..... B66B 1/468; B66B 2201/4615; B66B 5/0012; B66B 1/2408; B66B 2201/222; B66B 2201/103; B66B 2201/211; B66B 1/3446; B66B 1/3492; B66B 2201/403; B66B 2201/4669; B66B 1/52; B66B 11/02; B66B 2201/20; B66B 2201/101; B66B 1/00; B66B 2201/4607; B66B 1/34
See application file for complete search history.

(56) References Cited

U.S. PATENT DOCUMENTS 4,044,860 A 8/1977 Kaneko et al.
4,662,479 A 5/1987 Tsuji et al.
5,387,768 A 2/1995 Izard et al.
5,518,086 A 5/1996 Tyni
(Continued)

FOREIGN PATENT DOCUMENTS

CN 102482050 A * 5/2012 ..... B66B 1/2458
CN 102616614 A 8/2012
(Continued)

OTHER PUBLICATIONS

CN Office Action; dated Apr. 12, 2021; Application No. 201910510490.2; Filed: Jun. 13, 2019; 8 pages.
(Continued)

*Primary Examiner* — Marlon T Fletcher
(74) *Attorney, Agent, or Firm* — Cantor Colburn LLP

(57) ABSTRACT

Systems and methods floor bypass in an elevator system are provided. Aspects includes receiving, by the first controller, a first elevator destination call to a first floor, wherein the first destination call causes a first elevator car to dispatch to the first floor. First sensor data associated with a first passenger area associated with the first elevator car is collected, from the first sensor. A presence of a passenger in the first passenger area is detected based at least in part on the first sensor data. And the first elevator car is operated based on the presence of the passenger in the first passenger area.

10 Claims, 4 Drawing Sheets

(56) References Cited

U.S. PATENT DOCUMENTS

| | | | | |
|---|---|---|---|---|
| 5,952,626 | A | 9/1999 | Zaharia | |
| 6,209,685 | B1 | 4/2001 | Zaharia et al. | |
| 6,382,363 | B1 | 5/2002 | Friedli | |
| 6,615,175 | B1 | 9/2003 | Gazdzinski | |
| 7,387,191 | B2 | 6/2008 | Kostka et al. | |
| 7,552,800 | B2 | 6/2009 | Puskala et al. | |
| 7,711,565 | B1 | 5/2010 | Gazdzinski | |
| 8,020,672 | B2 | 9/2011 | Lin et al. | |
| 8,061,485 | B2 | 11/2011 | Finschi | |
| 8,210,321 | B2 | 7/2012 | Finschi et al. | |
| 8,944,219 | B2 | 2/2015 | Gerstenkorn | |
| 8,960,373 | B2 | 2/2015 | De Vincentis | |
| 9,079,751 | B2 | 7/2015 | Sundholm et al. | |
| 9,238,568 | B2 | 1/2016 | Nonami | |
| 9,802,789 | B2 | 10/2017 | Kim et al. | |
| 9,856,107 | B2 | 1/2018 | Haipus et al. | |
| 2012/0125719 | A1* | 5/2012 | Sundholm | B66B 1/2458 187/382 |
| 2015/0329316 | A1 | 11/2015 | Lee | |
| 2016/0347577 | A1* | 12/2016 | Simcik | B66B 1/3476 |
| 2018/0111793 | A1 | 4/2018 | Miyajima et al. | |
| 2019/0346588 | A1* | 11/2019 | Hsu | G01V 9/00 |
| 2019/0382233 | A1* | 12/2019 | Pusala | B66B 1/3461 |

FOREIGN PATENT DOCUMENTS

| | | | | | |
|---|---|---|---|---|---|
| CN | 102674095 | A | | 9/2012 | |
| CN | 1449353 | A | | 10/2013 | |
| CN | 103601047 | A | | 2/2014 | |
| CN | 102710894 | B | | 12/2014 | |
| CN | 103287939 | B | | 12/2015 | |
| CN | 104671047 | B | | 1/2016 | |
| CN | 103964271 | B | | 4/2016 | |
| CN | 206580426 | U | | 10/2017 | |
| CN | 110407040 | A | * | 11/2019 | B66B 1/14 |
| CN | 110606433 | A | | 12/2019 | |
| EP | 3098190 | A1 | * | 11/2016 | B66B 1/06 |
| EP | 3318524 | A1 | * | 5/2018 | B66B 1/06 |
| FI | 121421 | B1 | * | 11/2010 | B66B 1/2458 |
| JP | 20100899543 | A | | 4/2010 | |
| JP | 4606570 | B2 | | 1/2011 | |
| JP | 2013049561 | A | | 3/2013 | |
| JP | 7078461 | B2 | * | 5/2022 | B66B 1/2416 |
| KR | 20060130665 | A | * | 9/2006 | |

OTHER PUBLICATIONS

CN Office Action; dated Jun. 9, 2020; Application No. 201910510490.2; Filed: Jun. 13, 2019; 8 pages.

European Search Report; European Application No. 19180070.5; Application Filed: Jun. 13, 2019; Search Report dated Dec. 17, 2019.

Chinese Office Action for Application No. 201910510490.2; dated Jul. 15, 2022; 9 Pages.

* cited by examiner

ELEVATOR FLOOR BYPASS

CROSS-REFERENCE TO RELATED APPLICATIONS

This application claims the benefit of Indian provisional application no. 201811022368 filed Jun. 14, 2018, which is incorporated herein by reference in its entirety.

BACKGROUND

The subject matter disclosed herein generally relates to elevator systems and, more particularly, to a floor bypass for an elevator system.

Elevator cars in an elevator system typically respond to an elevator call when a passenger presses the physical call button in an elevator lobby. In some buildings, elevator cars can be partitioned into different elevator groups that serve the same floors in the building. Each of these elevator groups can have a call button on the same floor allowing for passengers to press more than one call button to call elevator cars from more than one elevator group. A passenger, while calling multiple elevator cars from more than one elevator group, will only board one elevator car causing the other elevator cars dispatched to the floor to waste power and increase other passenger wait times.

BRIEF DESCRIPTION

According to one embodiment, an elevator system is provided. The elevator system a first elevator group comprising one or more elevator cars, a first sensor operable to collect first sensor data associated with a first passenger area for the first elevator group, and a first controller coupled to a first memory, the first controller configured to operate the first elevator group and further configured to receive a first elevator destination call to a first floor, wherein the first elevator destination call causes the controller to dispatch a first elevator car from the first elevator group to the first floor. A presence of a passenger in the first passenger area is determined based at least in part on the first sensor data and the first elevator car is operated based on the presence of the passenger in the first passenger area.

In addition to one or more of the features described above, or as an alternative, further embodiments of the elevator system may include that the controller is further configured to cancel the first elevator destination call based at least in part on a determination the passenger has exited the first passenger area for greater than a first threshold amount of time.

In addition to one or more of the features described above, or as an alternative, further embodiments of the elevator system may include a second elevator group comprising one or more elevator cars, a second sensor operable to collect second sensor data associated with a second passenger area for the second elevator group, and a second controller coupled to a second memory, the controller configured to operate the second elevator group and further configured to receive a second elevator destination call to the first floor, wherein the second elevator destination call causes a second elevator car from the second elevator group to dispatch to the first floor. The controller further configured to determine a presence of the passenger in the second passenger area based at least in part on the second sensor data and operate the second elevator car based on the presence of the passenger in the second passenger area.

In addition to one or more of the features described above, or as an alternative, further embodiments of the elevator system may include that the second controller is further configured to cancel the second elevator destination call based at least in part on a determination the passenger has exited the second passenger area for greater than a second threshold amount of time.

In addition to one or more of the features described above, or as an alternative, further embodiments of the elevator system may include that the first sensor and second sensor comprise at least one of a camera or Doppler effect sensor.

In addition to one or more of the features described above, or as an alternative, further embodiments of the elevator system may include that the first passenger area comprises one or more locations proximate to the one or more elevator cars in the first elevator group.

In addition to one or more of the features described above, or as an alternative, further embodiments of the elevator system may include that the second passenger area comprises one or more locations proximate to the one or more elevator cars in the second elevator group.

In addition to one or more of the features described above, or as an alternative, further embodiments of the elevator system may include that the first passenger area overlaps with the second passenger area.

In addition to one or more of the features described above, or as an alternative, further embodiments of the elevator system may include that the first controller is further configured to responsive to cancelling the first elevator destination call, operate the first elevator car to proceed to a next elevator destination call.

According to one embodiment, a method is provided. The method includes receiving, by the first controller, a first elevator destination call to a first floor, wherein the first destination call causes a first elevator car from the first elevator group to dispatch to the first floor. First sensor data associated with a first passenger area associated with the first elevator group is collected, from the first sensor. A presence of a passenger in the first passenger area is detected based at least in part on the first sensor data. And the first elevator car is operated based on the presence of the passenger in the first passenger area.

In addition to one or more of the features described above, or as an alternative, further embodiments of the method may include cancelling the first elevator destination call based at least in part on a determination the passenger has exited the first passenger area for greater than a first threshold amount of time.

In addition to one or more of the features described above, or as an alternative, further embodiments of the method may include that the elevator system further comprises a second elevator group having one or more elevator cars, a second sensor, and a second controller and receiving, by the second controller, a second elevator destination call to the first floor, wherein the second destination call causes a second elevator car from the second elevator group to dispatch to the first floor. Collecting second sensor data, from the second sensor, associated with a second passenger area associated with the second elevator group, determine a presence of a passenger in the second passenger area based at least in part on the second sensor data, and operating the second elevator car based on the presence of the passenger in the second passenger area.

In addition to one or more of the features described above, or as an alternative, further embodiments of the method may include cancelling the second elevator destination call based at least in part on a determination the passenger has exited the second passenger area for greater than a second threshold amount of time.

In addition to one or more of the features described above, or as an alternative, further embodiments of the method may include that the first sensor and second sensor comprise at least one of a camera or Doppler effect sensor.

In addition to one or more of the features described above, or as an alternative, further embodiments of the method may include that the first passenger area comprises one or more locations proximate to the one or more elevator cars in the first elevator group.

In addition to one or more of the features described above, or as an alternative, further embodiments of the method may include that the second passenger area comprises one or more locations proximate to the one or more elevator cars in the second elevator group.

In addition to one or more of the features described above, or as an alternative, further embodiments of the method may include that the first passenger area overlaps with the second passenger area.

In addition to one or more of the features described above, or as an alternative, further embodiments of the method may include responsive to cancelling the first elevator destination call, operating the first elevator car to proceed to a next elevator destination call.

According to one embodiment, a method is provided. The method includes receiving, by the controller, a first elevator destination call to a first floor, wherein the first destination call causes a first elevator car from the first elevator group to dispatch to the first floor. A second elevator destination call to the first floor is received by the controller, wherein the second destination call causes a second elevator car from the second elevator group to dispatch to the first floor. Sensor data is collected, from the at least one sensor, associated with a passenger area associated with the first elevator group and the second elevator group. A presence of a passenger in the passenger area is determined based at least in part on the sensor data and the first elevator car and the second elevator car are operated based on the presence of the passenger in the passenger area.

In addition to one or more of the features described above, or as an alternative, further embodiments of the method may include cancelling at least one of the first elevator destination call or second elevator destination call based at least in part on a determination the passenger has exited the passenger are for greater than a threshold amount of time.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
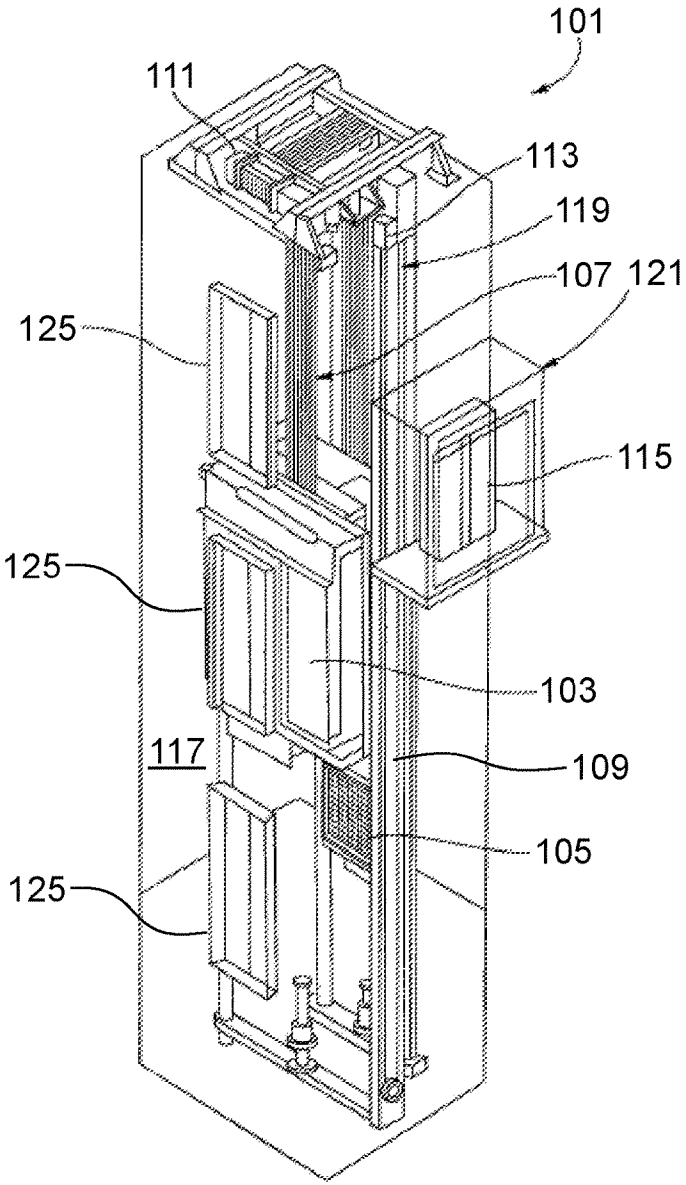
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
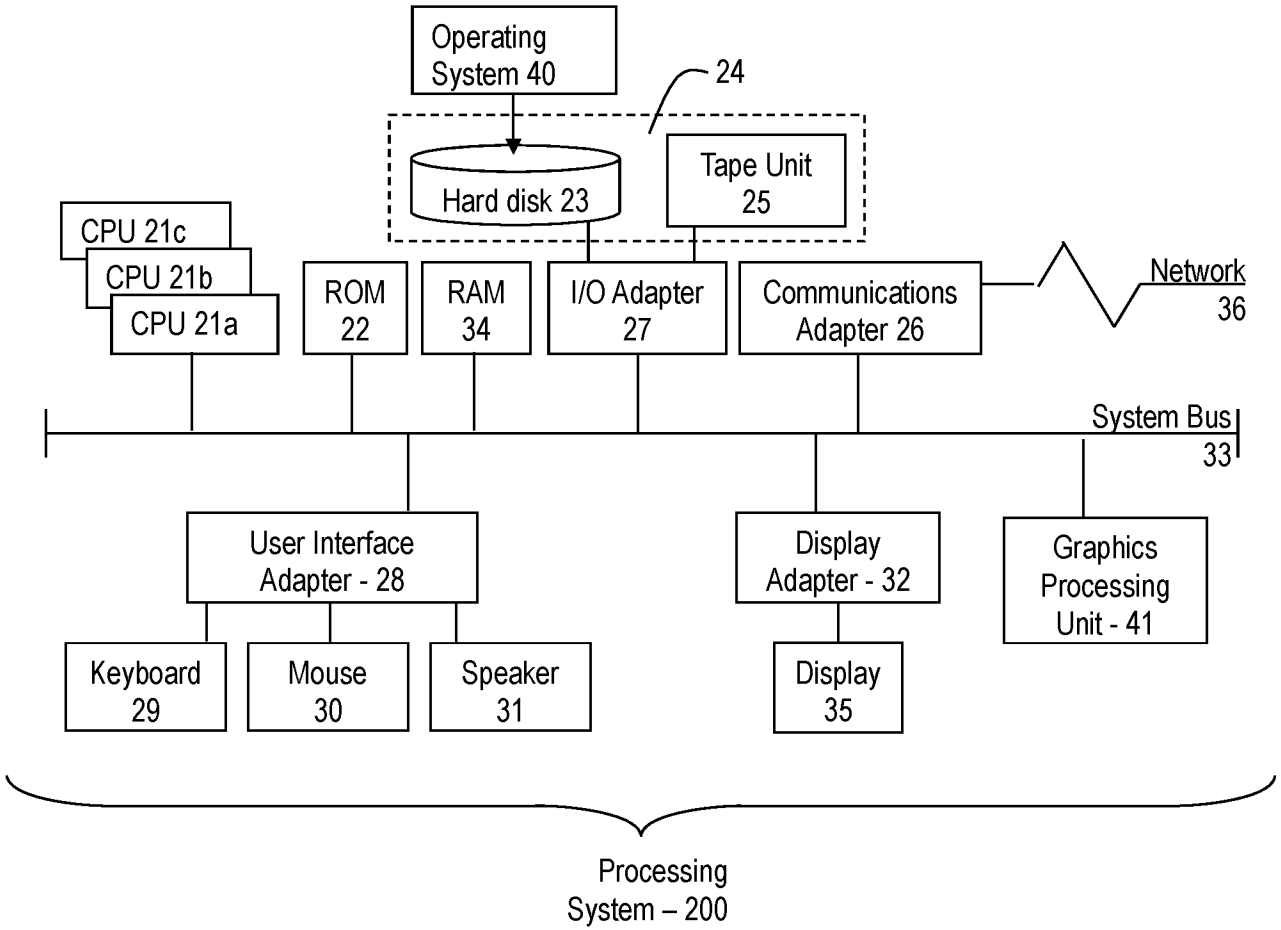
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc.

(collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of technologies that are more specifically relevant to aspects of the disclosure, elevator systems typically run the risk of deploying an elevator car to a specific floor of a building to where no passengers end up boarding the elevator car. Deploying, stopping, re-deploying elevator cars in an elevator system can cause increases in power consumption especially when the elevator cars are not being utilized by passengers. In addition to the increase in power consumption by the elevator system, these un-utilized hall calls can lead to increase travel time and passenger wait times for actual passengers in a building. This scenario often occurs in buildings with two or more elevator groups for each floor. A passenger can call both elevator groups and simply enter the elevator car in the elevator group that gets to the floor first leaving the other elevator group with an empty elevator car.

Turning now to an overview of the aspects of the disclosure, one or more embodiments address the above-described shortcomings of the prior art by providing an automatic floor bypass for an elevator system. The elevator system can detect the presence of passengers on a specific floor of a building before dispatching an elevator car or before stopping the elevator car at the floor if the elevator car has already been dispatched.

Figure 3:
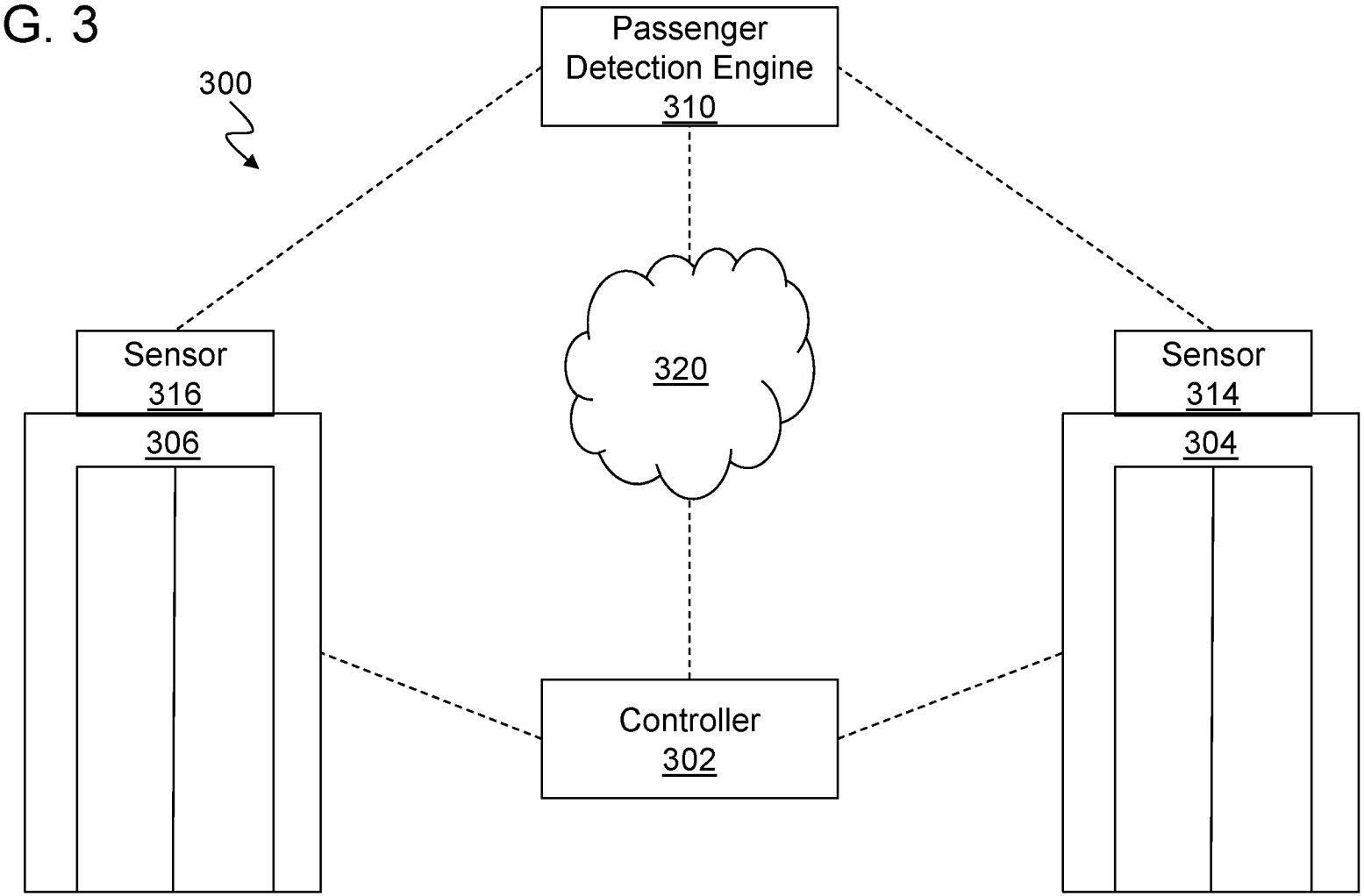
FIG. 3 depicts a block diagram of a system for floor bypass in an elevator system according to one or more embodiments of the disclosure.

Turning now to a more detailed description of aspects of the present disclosure, FIG. 3 depicts a system 300 for floor bypass in an elevator system according to one or more embodiments. The system 300 includes a controller 302, a first elevator car 304, a second elevator car 306, a passenger detection engine 310 in electronic communication with a first sensor 314 and a second sensor 316. The passenger detection engine 310 is in electronic communication with the controller 302 either directly or, as shown in the illustrated example, through a network 320.

In one or more embodiments, the controller 302, sensors 314, 316, and passenger detection engine can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein.

In one or more embodiments, the system 300 can be utilized in an elevator system that includes two or more elevator groups each having multiple elevator cars that can be dispatched to the same floor in a building. For example, parking garages attached to a building might have an elevator group that services the parking garage floors as well as a basement or service area floor. In the same elevator bank, a second elevator group might service the floors of the building and be limited as to the number of floors in the parking garage. In this scenario, the two elevator groups described overlap and when destination calls are made at a floor, more than one elevator car can be dispatched to the same floor. The destination call inputs might be near each other causing a passenger to select both in an effort to gain access to the faster or closer elevator car. When the passenger enters the elevator car that arrives first, the other elevator car is still being dispatched to the same floor. Since the passenger enters the first arriving elevator car, the other elevator car wastes resources by stopping at that floor. The system 300 described herein addresses this potential issue by determining a presence of a passenger before arriving at a floor for a destination call. The passenger detection engine 310 utilizes the first sensor 314 and second sensor 316 to monitor a first passenger area and a second passenger area to determine and confirm the presence of a passenger in these areas before the dispatched elevator cars stop at the requested floor.

In one or more embodiments, the first elevator car 304 is part of a first elevator group that services floors of a building and the second elevator car 306 is part of a second elevator group that services floors of the building. The controller 302 can be multiple controllers that can each operate only one of the elevator groups or can be one controller that operates both of the elevator groups. The controller 302 can communicate with the passenger detection engine either directly or through the network 320. In one or more embodiments, the controller 302 prior to stopping at a floor for a destination call can access or request presence information from the passenger detection engine 310 for the elevator cars 304, 306. The passenger detection engine 310 can operate the first sensor 314 and second sensor 316 to collect sensor data for a first passenger area and a second passenger area. The first passenger area can be one or more locations at or near the first elevator car 304 landing area or any location on a floor in a building. The second passenger area can be one or more locations at or near the second elevator car 306 landing are or any location on a floor in the building. In one or more embodiments, the first passenger area and the second passenger area can overlap. For example, the first elevator car 304 and second elevator car 306 can share the same elevator lobby on a floor and the dimensions of the lobby area can be used for the first and second passenger areas where the first sensor 314 and second sensor 316 collect the sensor data to determine passenger presence. While only two elevator cars and two sensors are shown in the illustrative example, in one or more embodiments, any number of elevator cars, sensors, controllers and/or passenger detection engines can be utilized in this system 300.

In one or more embodiments, the system 300 allows for an elevator car to bypass a floor where no passenger is detected in the passenger areas and proceed to the next elevator destination call. For example, a passenger on a floor being serviced by a first elevator group having a first elevator car 304 and also being serviced by a second elevator group having a second elevator car 306 can place two elevator destination call requesting either elevator car (304 or 306) from the first and second elevator group. In this example, the second elevator car 306 will arrive to the floor before the first elevator car 304. Prior to the arrival of the second elevator car 306, the controller 302 can send a request to the passenger detection engine 310 to confirm the presence of the passenger in the passenger area, through the sensor data collected by the second sensor 316, before stopping the second elevator car 306 at the floor. When the passenger enters the second elevator car 306, the passenger leaves the passenger area. In one or more embodiments, the passenger detection engine 310 can continuously monitor the passenger area to determine the presence of a passenger and when the passenger leaves the passenger area for an amount of time that exceeds a threshold time, the passenger detection engine 310 can alert the controller 302. In this scenario, once the controller 302 is alerted by the passenger detection engine 310 that no passengers are present on the floor, the controller 302 can cancel any pending destination calls to that specific floor. In this case, the pending destination call would be the destination call for the first elevator car 304 since the passenger has already entered the second elevator car 306 thus leaving the passenger area. In another embodiment, prior to the elevator car 304 arriving at the destination floor, the controller 302 can send a request to the passenger detection engine 310 to determine a presence of a passenger in the passenger area. Based on a passenger being present, the controller 302 will operate the first elevator car 304 to stop at the destination floor. Alternatively, based on a passenger not being present in the passenger area, the controller 302 will operate the first elevator car 304 to bypass the destination floor and proceed to the next, if any, destination call.

In one or more embodiments, the first sensor 314 and the second sensor 316 can be any combination of sensors including, but not limited to, image sensing hardware (e.g., panoramic cameras) or Doppler effect sensors. Also, in the illustrated example, only one sensor is present on the elevator car, but any number of sensors can be arranged on or near the elevator cars to monitor the passenger areas for passenger presence.

Figure 4:
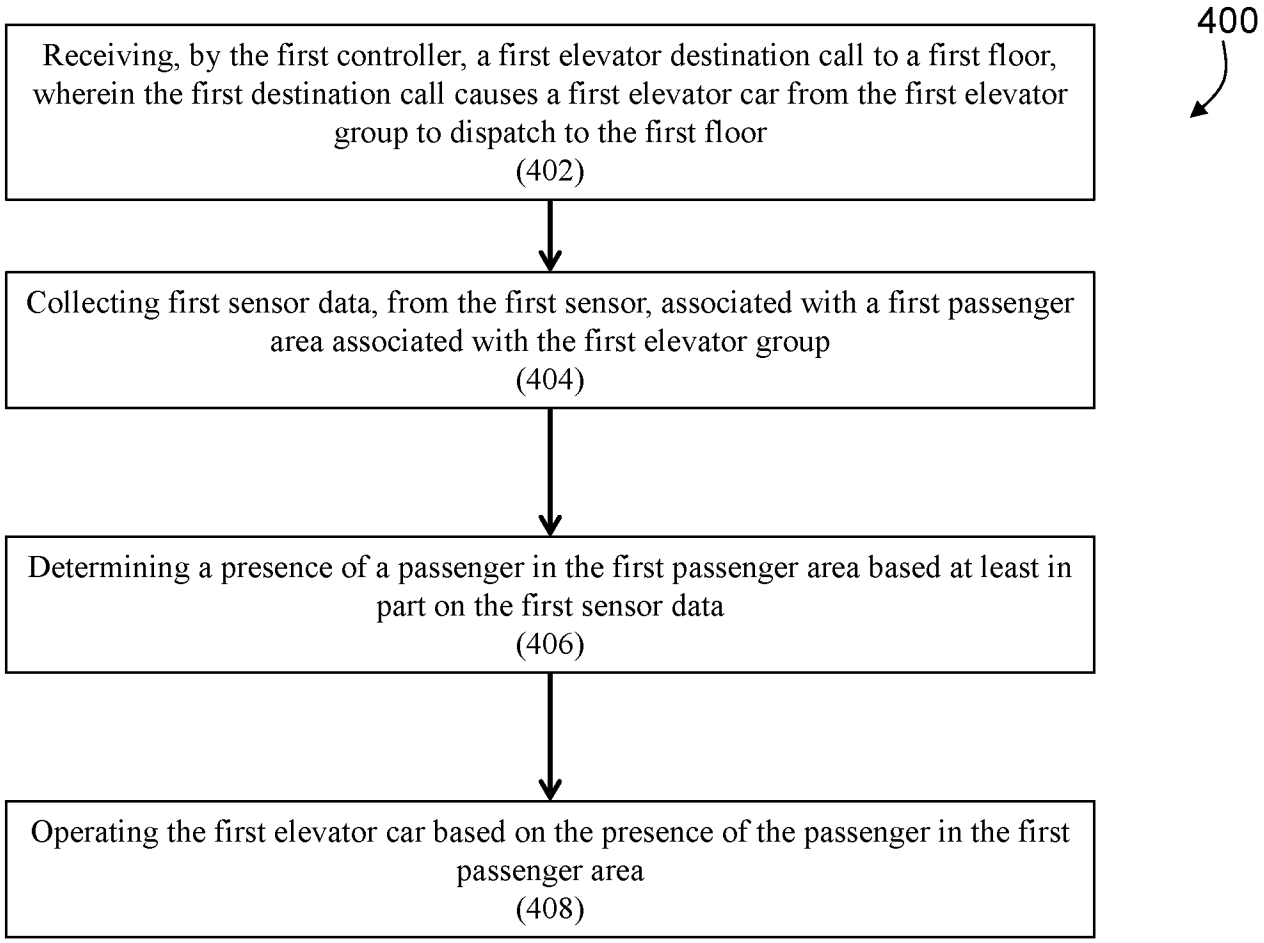
FIG. 4 depicts a flow diagram of a method for floor bypass in an elevator system according to one or more embodiments of the disclosure.

FIG. 4 depicts a flow diagram of a method for floor bypass for an elevator system according to one or more embodiments. The method 400 includes receiving, by the first controller, a first elevator destination call to a first floor, wherein the first destination call causes a first elevator car from the first elevator group to dispatch to the first floor, as shown in block 402. At block 404, the method 400 includes collecting first sensor data, from the first sensor, associated with a first passenger area associated with the first elevator group. The method 400, at block 406, includes determining a presence of a passenger in the first passenger area based at least in part on the first sensor data. And at block 408, the method 400 includes operating the first elevator car based on the presence of the passenger in the first passenger area.

Additional processes may also be included. It should be understood that the processes depicted in FIG. 4 represent illustrations and that other processes may be added or existing processes may be removed, modified, or rearranged without departing from the scope and spirit of the present disclosure.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:

a first elevator car of a first elevator group and a second elevator car of a second elevator group;

a first sensor operable to collect first sensor data associated with a first passenger area for the first elevator car and a second sensor operable to collect second sensor data associated with a second passenger area for the second elevator car;

a first controller coupled to a first memory, the first controller configured to operate the first elevator car and further configured to:

receive a first elevator destination call to a first floor, wherein the first elevator destination call causes the controller to dispatch the first elevator car to the first floor;

determine a presence of a passenger in the first passenger area based at least in part on the first sensor data; and operate the first elevator car based on the presence of the passenger in the first passenger area;

the elevator system further comprising:

a second controller coupled to a second memory, the second controller configured to operate the second elevator car and further configured to:

receive a second elevator destination call to the first floor, wherein the second elevator destination call causes the second elevator car to dispatch to the first floor;

determine a presence of the passenger in the second passenger area based at least in part on the second sensor data; and operate the second elevator car based on the presence of the passenger in the second passenger area;

wherein the first passenger area comprises one or more locations proximate to the first elevator car;

wherein the second passenger area comprises one or more locations proximate to the second elevator car;

wherein the first passenger area overlaps with the second passenger area.

2. The elevator system of claim 1, wherein the first controller is further configured to cancel the first elevator destination call based at least in part on a determination the passenger has exited the first passenger area for greater than a first threshold amount of time.

3. The elevator system of claim 1, wherein the second controller is further configured to cancel the second elevator destination call based at least in part on a determination the passenger has exited the second passenger area for greater than a second threshold amount of time.

4. The elevator system of claim 1, wherein the first sensor and second sensor comprise at least one of a camera or Doppler effect sensor.

5. The elevator system of claim 2, wherein the first controller is further configured to:

responsive to cancelling the first elevator destination call, operate the first elevator car to proceed to a next elevator destination call.

6. A method for floor bypass in an elevator system, the elevator system comprising a first elevator car of a first elevator group, a first sensor, a first controller, a second elevator car of a first elevator group, a second sensor and a second controller, the method comprising:

receiving, by the first controller, a first elevator destination call to a first floor, wherein the first destination call causes the first elevator car to dispatch to the first floor;

collecting first sensor data, from the first sensor, associated with a first passenger area associated with the first elevator car;

determining a presence of a passenger in the first passenger area based at least in part on the first sensor data; and operating the first elevator car based on the presence of the passenger in the first passenger area;

the method further comprising:

receiving, by the second controller, a second elevator destination call to the first floor, wherein the second destination call causes the second elevator car to dispatch to the first floor;

collecting second sensor data, from the second sensor, associated with a second passenger area associated with the second elevator car determine a presence of a passenger in the second passenger area based at least in part on the second sensor data; and operating the second elevator car based on the presence of the passenger in the second passenger area;

wherein the first passenger area comprises one or more locations proximate to the first elevator car;

wherein the second passenger area comprises one or more locations proximate to the second elevator car;

wherein the first passenger area overlaps with the second passenger area.

7. The method of claim 6 further comprising cancelling the first elevator destination call based at least in part on a determination the passenger has exited the first passenger area for greater than a first threshold amount of time.

8. The method of claim 6 further comprising cancelling the second elevator destination call based at least in part on a determination the passenger has exited the second passenger area for greater than a second threshold amount of time.

9. The method of claim 6, wherein the first sensor and second sensor comprise at least one of a camera or Doppler effect sensor.

10. The method of claim 7 further comprising responsive to cancelling the first elevator destination call, operating the first elevator car to proceed to a next elevator destination call.

* * * * *